US009072362B2

(12) United States Patent
Gallup

(10) Patent No.: US 9,072,362 B2
(45) Date of Patent: Jul. 7, 2015

(54) COLLAPSIBLE UTILITY TRAY WITH FLEXIBLE MOUNTING FEATURE

(76) Inventor: Eric Gallup, Rochester, MI (US)

( * ) Notice: Subject to any disclaimer, the term of this patent is extended or adjusted under 35 U.S.C. 154(b) by 0 days.

(21) Appl. No.: 13/481,468

(22) Filed: May 25, 2012

(65) Prior Publication Data

US 2013/0048587 A1 Feb. 28, 2013

Related U.S. Application Data

(60) Provisional application No. 61/527,356, filed on Aug. 25, 2011.

(51) Int. Cl.

| | |
|---|---|
| ***A47F 3/14*** | (2006.01) |
| ***A47F 5/08*** | (2006.01) |
| ***A47J 47/00*** | (2006.01) |
| ***A47B 43/00*** | (2006.01) |
| ***A47B 47/00*** | (2006.01) |
| ***A47B 57/00*** | (2006.01) |
| ***A45F 5/00*** | (2006.01) |
| ***A47F 5/11*** | (2006.01) |
| ***A47B 43/02*** | (2006.01) |
| ***A47B 96/02*** | (2006.01) |
| ***A47F 5/01*** | (2006.01) |
| ***A47B 55/02*** | (2006.01) |
| ***A47B 23/02*** | (2006.01) |
| ***A47B 55/06*** | (2006.01) |
| ***A47F 5/13*** | (2006.01) |
| ***A47G 29/00*** | (2006.01) |
| *A47G 25/06* | (2006.01) |

(52) U.S. Cl.

CPC ..... *A45F 5/00* (2013.01); *A47G 25/0614* (2013.01); *A47F 5/112* (2013.01); *A47B 43/02* (2013.01); *A47B 43/003* (2013.01); *A47B 43/00* (2013.01); *A47B 96/027* (2013.01); *A47F 5/01* (2013.01); *A47B 55/02* (2013.01); *A47F 3/147* (2013.01); *A47B 23/02* (2013.01); *A47B 55/06* (2013.01); *A47F 5/13* (2013.01); *A47G 29/00* (2013.01); *A45F 2200/0516* (2013.01)

(58) Field of Classification Search

CPC .... A47B 96/027; A47B 96/02; A47B 96/028; A47B 96/024; A47B 96/025; A47B 96/061; A47B 57/42; A47B 96/067; A47B 47/022; A47B 47/02; A47B 47/06; A47B 46/00; A47B 46/005; A47B 55/02; A47B 55/06; A47B 57/52; A47B 31/06; A47B 5/00; A47B 5/006; A47B 23/02; A47B 23/00; A47B 23/025; A47B 5/04; A47B 96/022; A47B 43/003; A47B 43/006; A47B 57/46; A47B 57/04; A47B 57/045; A47B 45/00; A47B 43/04; A47B 43/00; A47B 2097/003; A47B 2097/005; A47B 2097/006; A47B 97/08; A47B 43/02; A47F 5/0043; A47F 5/0081; A47F 5/01; A47F 5/08; A47F 5/10; A47F 5/13; A47F 3/14; A47F 3/145; A47F 3/147; A47F 5/0031; A47F 5/0892; A47F 7/143; A47F 7/148; A47F 5/112; A47F 5/114; A47F 5/116; A47J 47/16; A47G 25/0685; A47G 29/00; A47G 25/746; A47G 25/0614; A47G 25/0621; A47G 25/0635; D06F 81/06; D06F 57/12; A47D 1/008; A47C 7/62; A47C 7/70; A47C 21/00; A47K 10/10; A47K 10/08; A45C 5/00; A45C 2200/0516; B65D 7/26; B65D 21/0211; B65D 63/12; B65D 63/10; B60N 3/004; A61G 7/05

USPC ..... 5/503.1, 507.1, 658; 24/30.5 T; 362/382; 108/47, 49, 23, 135; 211/90.02, 90.01, 90.03, 133.6, 133.5, 211/133.2, 133.3, 126.9, 181.1, 126.1, 193, 211/86.01, 87.01, 132.1, 195, 85.31, 85.29, 211/85.26, 104, 119.006, 70.6, 26.2, 113,

211/119, 119.004, 119.009, 126.5, 211/119.007; 248/235

See application file for complete search history.

(56) References Cited

U.S. PATENT DOCUMENTS

| | | | | | |
|---|---|---|---|---|---|
| 2,633,998 | A * | 4/1953 | Derman et al. | 211/104 |
| 2,958,424 | A * | 11/1960 | Bigatti | 211/41.5 |
| 3,315,877 | A * | 4/1967 | Grevich | 383/91 |
| 3,400,829 | A * | 9/1968 | Youngson | 211/119.006 |
| 3,522,888 | A * | 8/1970 | Grams et al. | 211/132.1 |
| 4,466,659 | A * | 8/1984 | Carpentier et al. | 297/188.06 |
| 4,484,378 | A * | 11/1984 | Kimura et al. | 24/30.5 S |
| 4,623,793 | A * | 11/1986 | Hofke et al. | 250/341.2 |
| 4,765,495 | A * | 8/1988 | Bisk | 211/113 |
| 4,815,764 | A * | 3/1989 | Carpenter | 280/769 |
| 4,889,057 | A * | 12/1989 | Chartrand | 108/42 |
| 4,978,013 | A * | 12/1990 | Hogg | 211/133.2 |
| 5,269,229 | A * | 12/1993 | Akapatangkul | 108/44 |
| 5,421,499 | A * | 6/1995 | Bauer | 224/270 |
| 5,564,566 | A * | 10/1996 | Lamb | 206/373 |
| 5,615,434 | A * | 4/1997 | Cracchiolo et al. | 5/658 |
| 5,653,178 | A * | 8/1997 | Huczka | 108/47 |
| 5,699,564 | A * | 12/1997 | Heh | 5/503.1 |
| 5,875,902 | A * | 3/1999 | Emery et al. | 211/90.03 |
| 5,878,672 | A * | 3/1999 | Ostermann et al. | 108/44 |
| 5,916,006 | A * | 6/1999 | Ganson | 446/85 |
| 6,026,528 | A * | 2/2000 | Pina | 5/658 |
| 6,312,278 | B1 * | 11/2001 | Prior | 439/371 |
| 6,330,949 | B1 * | 12/2001 | DeRisio | 211/85.7 |
| 6,497,331 | B1 * | 12/2002 | Morandi | 211/153 |
| 6,848,663 | B2 * | 2/2005 | Olive | 248/317 |
| 7,043,778 | B1 * | 5/2006 | Georgitsis et al. | 5/93.1 |
| 7,421,958 | B2 * | 9/2008 | Ciulla | 108/44 |
| 8,176,601 | B2 * | 5/2012 | Orr | 24/30.5 R |
| 2001/0039903 | A1 * | 11/2001 | Patterson | 108/44 |
| 2003/0000905 | A1 * | 1/2003 | Zidek | 211/205 |
| 2003/0029821 | A1 * | 2/2003 | Shone | 211/90.03 |
| 2003/0066462 | A1 * | 4/2003 | Getfield | 108/44 |
| 2004/0099567 | A1 * | 5/2004 | Frank | 206/562 |
| 2006/0180557 | A1 * | 8/2006 | Weinstein et al. | 211/40 |
| 2007/0063524 | A1 * | 3/2007 | Daniel | 294/147 |
| 2009/0184077 | A1 * | 7/2009 | Curet et al. | 211/117 |
| 2009/0308286 | A1 * | 12/2009 | Bourbeau | 108/23 |
| 2010/0101459 | A1 * | 4/2010 | Nelson | 108/47 |
| 2011/0286217 | A1 * | 11/2011 | Martinson et al. | 362/253 |
| 2012/0240343 | A1 * | 9/2012 | Gully | 8/137 |
| 2013/0026316 | A1 * | 1/2013 | Case et al. | 248/205.1 |
| 2013/0032617 | A1 * | 2/2013 | Adelman et al. | 224/191 |

OTHER PUBLICATIONS

Gear Tie, Reusable Rubber Twist Tie, http://www.niteize.com/collections/gear-tie Web May 25, 2012.

* cited by examiner

*Primary Examiner* — Jennifer E Novosad

(74) *Attorney, Agent, or Firm* — Carlson, Gaskey & Olds P.C.

(57) ABSTRACT

A collapsible utility tray device with a flexible mounting feature. The device includes a main tray portion for holding various items as desired by a user. A combined back/top piece is hinged to the main tray portion, such that the back/top can be folded closed to serve as a lid for the tray, or can be folded open to serve as a back structure for mounting the device and holding the tray portion horizontal. The back/top piece is fitted with a large rubberized twist tie for flexibly attaching the device to an object. The large rubberized twist tie can also be used to keep the device closed when the back/top piece is folded down. The device further includes smaller rubberized twist ties which can be used for hanging other small items from the tray or securing items to the tray. A small light can also be included in the device.

20 Claims, 3 Drawing Sheets

COLLAPSIBLE UTILITY TRAY WITH FLEXIBLE MOUNTING FEATURE

CROSS REFERENCE TO RELATED APPLICATIONS

This application claims the benefit of the priority date of U.S. Provisional Patent Application No. 61/527,356, titled Collapsible Utility Tray with Flexible Mounting Feature, filed Aug. 25, 2011.

BACKGROUND OF THE INVENTION

1. Field of the Invention

This invention relates generally to a collapsible utility tray device and, more particularly, to a utility tray for holding small items including a hinged back that can be folded down for compactness, a large rubberized twist tie that can be used for mounting the tray to a wide variety of objects, and smaller rubberized twist ties for hanging or securing other items.

2. Discussion of the Related Art

There has long been a need for a simple yet versatile tray-type device for holding small items, especially a device which can easily and temporarily be mounted to many different types of structures to hold the items in a convenient location. With the proliferation of electronic devices, such as cell phones and MP3 players and their associated charging cords, remote controls for televisions and other video devices, etc., many people have an even greater need for such a storage tray.

Existing utility trays tend to suffer from a common shortcoming—that is, they are either difficult to mount, or they can only be mounted to certain types of surfaces, or both. Furthermore, most existing trays are designed for semi-permanent installation, with screws or mounting tape for example, and thus cannot easily be picked up and moved from one location to another. Existing tray designs also lack the flexibility to attach or secure items either in or on the tray, particularly where the attachment is fast, flexible and temporary in nature.

There remains a need for a utility tray with a secure yet simple and flexible mounting feature, which can easily be removed from its mounted position and closed for compactness and portability, and which includes other features for convenient attachment of small items.

SUMMARY OF THE INVENTION

In accordance with the teachings of the present invention, a collapsible utility tray device with a flexible mounting feature is disclosed. The device includes a main tray portion for holding various items as desired by a user. A combined back/top piece is hinged to the main tray portion, such that the back/top can be folded closed for compactness or to partially cover the tray, or can be folded open to serve as a back structure for mounting the device and holding the tray portion horizontal. The back/top piece is fitted with a large rubberized twist tie for flexibly attaching the device to an object. The large rubberized twist tie can also be used to keep the device closed when the back/top piece is folded down. The device further includes smaller rubberized twist ties which can be used for hanging other small items from the tray or securing items to the tray. A small light can also be included in the device.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a collapsible utility tray with a flexible mounting feature is merely exemplary in nature, and is in no way intended to limit the invention or its applications or uses.

Many people have a need for a simple, portable storage tray for holding small items. One example of such a person is a college student living in a dormitory room, with little space to spare. A typical college student has a smart phone which is used for many purposes, including serving as an alarm clock. Such a student needs a means of keeping the smart phone close to his or her bed, while still being accessible to a charging cord. A utility tray as disclosed herein could serve this function. The tray could also hold keys or other small items, and would ideally be mountable to something like a bed rail with no tools and no damage to the bed.

Modern materials and manufacturing processes make it possible to design a utility tray which meets the need described above, while at the same time being inexpensive, lightweight, strong, and flexible in mounting configuration. Two different embodiments of the utility tray are described and shown in this disclosure. Other embodiments are also possible.

Figure 1:
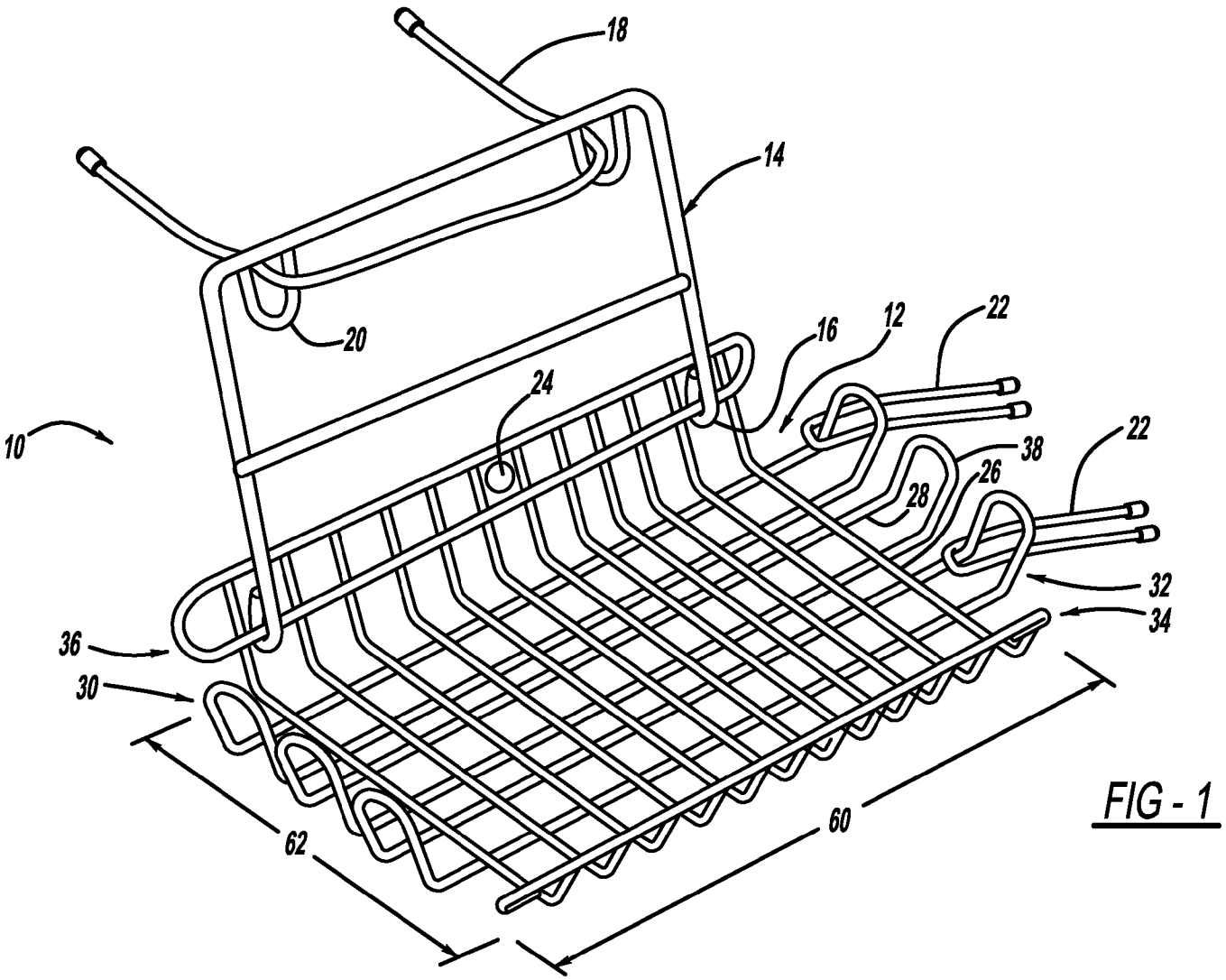
FIG. 1 is an isometric view illustration of a first embodiment of a collapsible utility tray with a flexible mounting feature.
Figure 2:
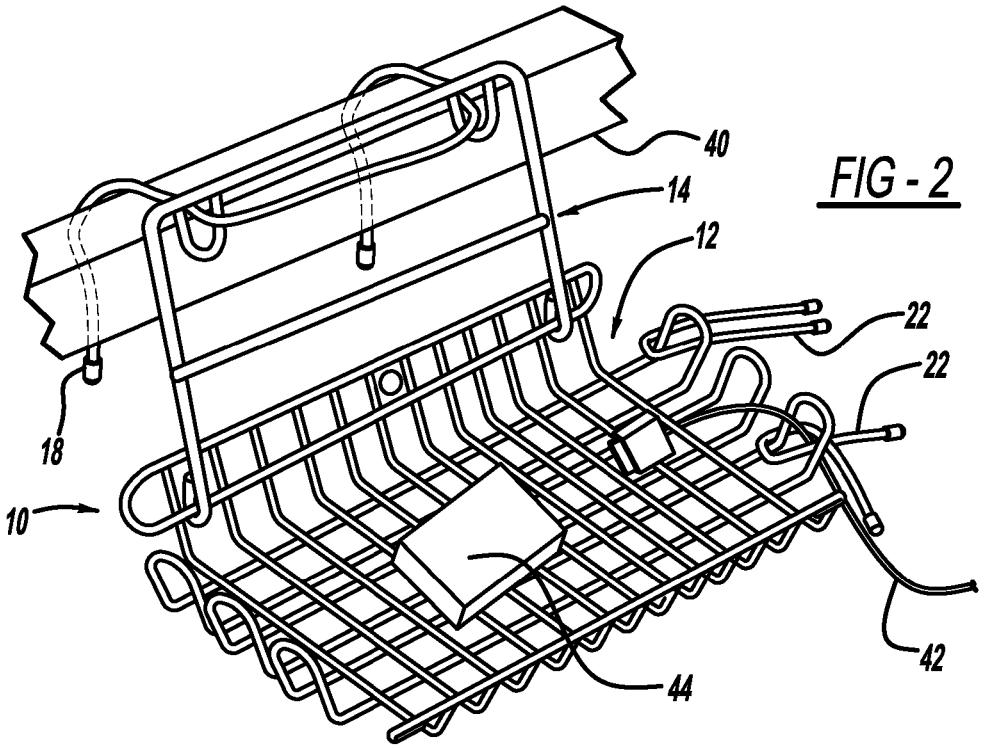
FIG. 2 is an isometric view illustration of the first embodiment of the collapsible utility tray of FIG. 1, shown mounted in a typical configuration.
Figure 3:
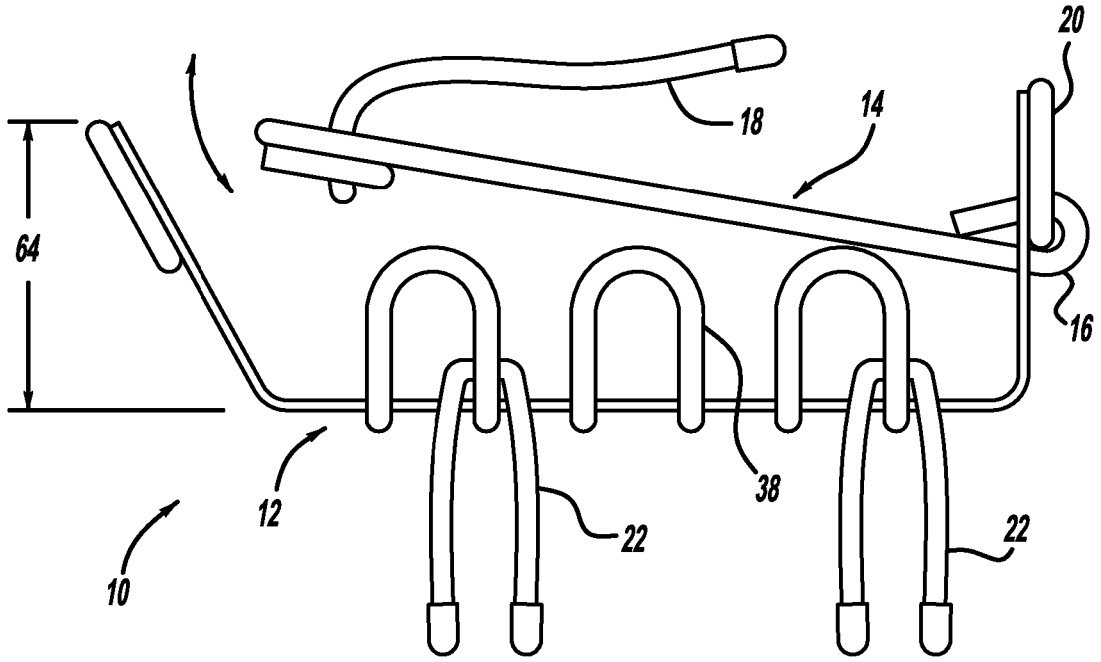
FIG. 3 is a side view of the collapsible utility tray of FIGS. 1 and 2, showing how the back/top can be folded closed over the tray.

FIG. 1 is an isometric view illustration of a first embodiment of a collapsible utility tray 10. The embodiment shown in FIGS. 1-3 is a welded wire design. The tray 10 includes as its two primary components a tray body 12 and a back/top 14. The tray body 12 is designed to accommodate various small personal items that a person may wish to keep handy. Such items include a mobile phone, a digital music player, keys, glasses, cigarettes and lighter, a wallet, and electronic device chargers, among other things. The back/top 14 is designed to serve as both a back—or structural support—for hanging the tray 10, and as a partial lid for covering the tray body 12 to form an enclosure. For these purposes, a pair of hinge loops 16 connect the back/top 14 to the tray body 12 as shown.

The tray body 12 is preferably constructed of a lattice of lateral wires 26 and longitudinal wires 28, welded at each contact point. The wires 26 and 28 further comprise a first end portion 30, a second end portion 32, a front face portion 34 and a rear face portion 36. The end portions 30 and 32 and face portions 34 and 36 provide the lateral enclosure surfaces necessary to prevent items from falling off of or out of the tray body 12. In a preferred construction embodiment of the utility tray 10, the first end portion 30 and the second end portion 32 are formed by bending the longitudinal wires 28 up and over into wire loops 38, thus simplifying fabrication. A similar technique could be used for the front face portion 34. The construction shown in FIGS. 1-3 is simply representative of one preferred embodiment. Other welded wire mesh constructions are easily envisioned.

The tray body 12, the back/top 14 and the hinge loops 16 are designed so that the back/top 14 can only rotate open about 90 degrees relative to the tray body 12. This is to allow the utility tray 10 to be attached to an external structure (as discussed below) and have the tray body 12 remain in an approximately horizontal position as shown in FIG. 1. The folding design for the back/top 14 also makes the entire utility tray 10 very compact when stored.

A mounting tie strap 18 is included to allow fast, easy, flexible mounting of the utility tray 10 to many different types of mounting structures. The mounting tie strap 18 is one of the "rubberized flexible twist ties" which are available on the market, comprised of a metal wire encased in rubber. The mounting tie strap 18 must be long enough—approximately twice the length of the tray body 12—to be wrapped securely around the mounting structure. Likewise, the mounting tie strap 18 must be substantial enough in diameter to support the weight of the utility tray 10 and its contents without sagging or unbending. The mounting tie strap 18 simply passes through two loop holes 20 in the back/top 14. When not needed for mounting, the mounting tie strap 18 can be removed from the loop holes 20 and placed in the tray body 12, or used for other purposes.

Rubber twist ties 22 are included in the design of the utility tray 10, allowing a user to secure any number of different types of items to either the inside or the outside of the tray body 12. In the figures, two of the rubber twist ties 22 are shown, wrapped around the longitudinal wires 28. However, in practice, any number of the twist ties 22 can be provided, and they can be attached to any part of the tray body 12 or the back/top 14. Thus, the user has ultimate flexibility to use as many of the twist ties 22 as desired, place them in the locations needed, and even remove them altogether when not needed. The rubber twist ties 22, like the mounting tie strap 18, are "rubberized flexible twist ties" which are commonly available on the market.

A light 24 can be included in the utility tray 10, with a location in the hinged edge of the tray body 12 being shown. Other locations for the light 24, such as in the back/top 14, or elsewhere in the tray body 12, are possible. The light 24 would most preferably have a low physical profile, low energy consumption properties, and low heat generation. A small light emitting diode (LED) for the light 24 is envisioned as a preferred embodiment. A switch (not shown) could be built into the light 24 or placed adjacent to it. A small battery (not shown) could be built into the light 24, or could be provided anywhere in or on the utility tray 10 as appropriate.

FIG. 2 shows the utility tray 10, with contents, attached to a bed rail 40. The ends of the mounting tie strap 18 are shown bent around the bed rail 40 to support the utility tray 10. As discussed above, this mounting and support arrangement provides a great deal of flexibility in terms of the type of structures that the utility tray 10 can be mounted to. It also allows very fast and easy attachment and detachment, for situations where the tray 10 needs to be moved from location to location. Also shown in FIG. 2 is how the rubber twist ties 22 can be used to secure a charging cord 42 on the outside of the tray body 12 so that the cord 42 is conveniently positioned for usage inside the tray body 12. Many other uses for the rubber twist ties 22 are possible, of course. Another item 44, which could be a cell phone or a wallet, is also shown in the tray body 12.

FIG. 3 is a side view of the utility tray 10 showing how the back/top 14 can be folded down on the tray body 12 to form a partially enclosed unit for portability, and for compactness during storage. When closed for storage or transport, the mounting tie strap 18 can be wrapped around the utility tray 10 to hold it securely shut, or it can be simply folded back out of the way as shown. Alternatively, the mounting tie strap 18 can be removed from the loop holes 20 and placed inside the tray body 12, or used for other purposes. Similarly, the rubber twist ties 22 could be left in their usage position as shown in FIGS. 1 and 2, or they could be removed and placed inside the utility tray 10 for storage or transport.

In a typical design of the utility tray 10, the tray body 12 has a length 60 between 8 and 16 inches, a width 62 between 6 and 12 inches, and a height 64 between 1 and 3 inches. Larger or smaller designs may also be suitable for some purposes.

Figure 4:
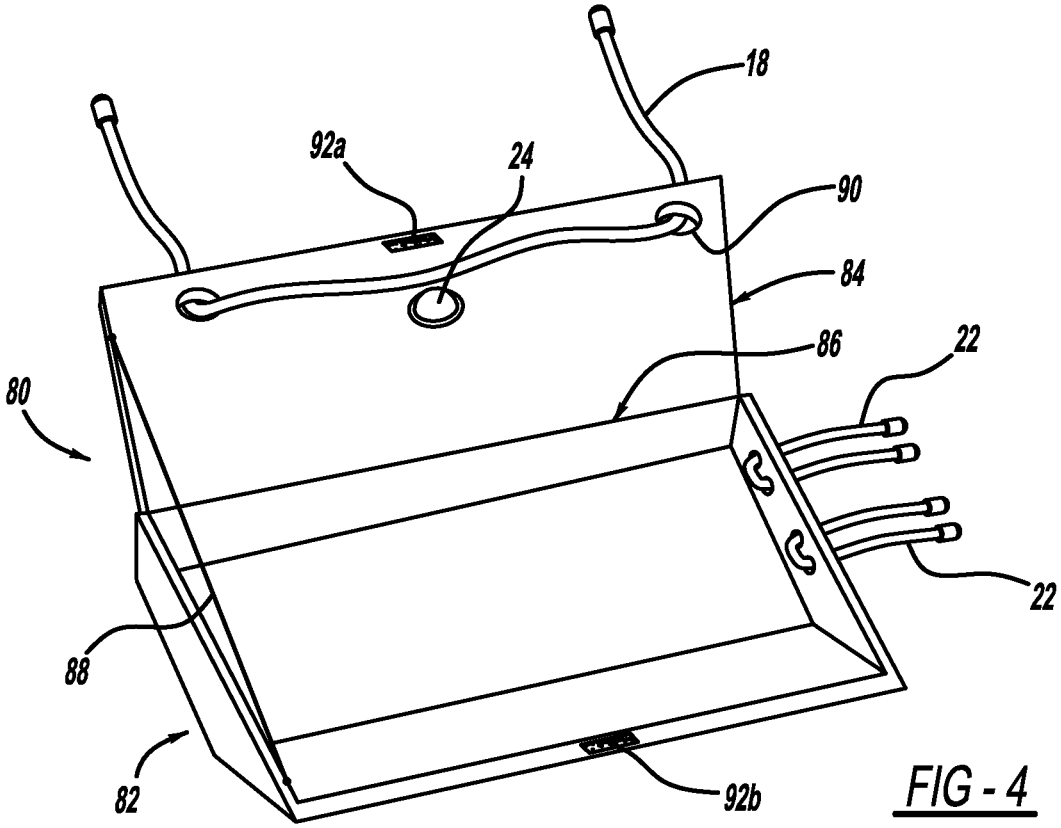
FIG. 4 is an isometric view illustration of a second embodiment of a collapsible utility tray with a flexible mounting feature.
Figure 5:
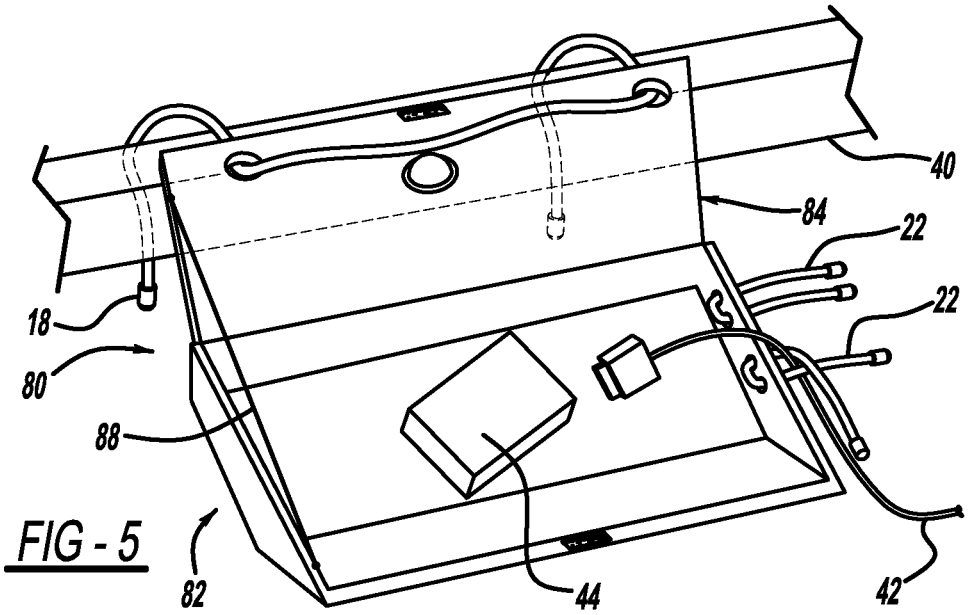
FIG. 5 is an isometric view illustration of the second embodiment of the collapsible utility tray of FIG. 4, shown mounted in a typical configuration.

FIGS. 4 and 5 are isometric view illustrations of a second embodiment of a collapsible utility tray 80. The utility tray 80 has the same usage and flexible mounting features as the utility tray 10 discussed above, but a substantially different construction. The utility tray 80 shown in FIGS. 4 and 5 is a molded plastic design. The plastic used in the utility tray 80 could either be solid (as shown) or perforated with holes to reduce material usage and weight.

In the utility tray 80, a tray body 82 is attached to a back/top 84 via a hinge 86. The hinge 86 can be one or more separate pieces attached to the tray body 82 and the back/top 84, or the hinge 86 can molded directly into the tray body 82 and the back/top 84 as mechanically-interconnecting protrusions. Alternatively, the tray body 82 and the back/top 84 can be molded as a single integral unit, with the hinge 86 being a "living hinge"—or thin, flexible folding axis.

As discussed above with respect to FIGS. 1-3, the back/top 84 can only be allowed to rotate open about 90 degrees from the fully closed position. This is so that the utility tray 80 can be attached to an external structure and have the tray body 82 remain in an approximately horizontal position as shown in FIGS. 4 and 5. The restricted opening angle of the back/top 84 can be accomplished in at least two ways. First, the hinge 86 itself can be a limited-rotation hinge, as is commonly known by those skilled in hardware design. In a limited-rotation hinge, tabs or other features are included which prevent hinge rotation past a certain angle. Second, a tension member 88 could be attached to both the tray body 82 and the back/top 84, thus preventing the back/top 84 from opening beyond a certain distance or angle. The tension member 88 could be comprised of a piece of string, a flexible metal wire, a plastic strap, or other suitable material.

In FIGS. 4 and 5, two of the rubber twist ties 22 are shown protruding through holes in one end of the tray body 82. However, in practice, holes can be provided in all four sides of the tray body 82, or throughout the tray body 82 and the back/top 84, and several of the twist ties 22 can be provided. As discussed previously, this gives the user the flexibility to use as many of the twist ties 22 as desired, place them in the locations in the tray body 82 as needed, and remove them altogether when not needed.

The mounting tie strap 18 can be wrapped around the tray body 82 to hold the back/top 84 closed for storage or transport. Alternatively, the mounting tie strap 18 can be removed from holes 90 and placed inside the utility tray 80, and a closure (92*a*, 92*b*), such as a snap, a magnet, or hook and loop fastener material, could be used to hold the utility tray 80 closed.

In some applications, it may be desirable to include internal dividers within the tray body 82. The internal dividers (not shown in figures) could be permanently formed into the tray body 82, or could be user-configurable.

The bedside mounting application described previously is but one of many possible uses for the utility tray 10. (The utility tray 80 could be used interchangeably with the utility tray 10 in the ensuing discussion.) Functioning like a portable night stand, the tray 10 would be ideally suited for college dorms and military barracks, where occupants have little more than a bed for personal space. Travelers may also find the tray 10 to be useful in hotel rooms, where personal items including the room key card could be placed in the tray 10 instead of scattered around on top of different pieces of furniture.

A similar application would be in hospitals and nursing homes, where the portability feature of the tray 10 would be particularly convenient. A person could keep the tray 10, containing personal items including medications along with the other items mentioned previously, attached to or near the bed in their room. Then, if the person went for a ride in a wheelchair, the tray 10 could easily be attached to the wheelchair and go along for the ride. This could be done, using the mounting tie strap 18, without removing or handling the personal items contained in the tray 10.

The tray 80 in particular may also be popular among fishermen, who could use the tray 80 as a small tackle box, easily closable, portable, and securely attachable to whatever structure is available in a boat or on a pier. Similarly, hunters may find the tray 10 or the tray 80 suitable for holding game calls, ammunition, and other items—either in a hunting blind, or simply attached to a tree via the mounting tie strap 18. For purposes such as this, it may be desirable to include two or more sizes of the mounting tie strap 18, where a longer size would be able to wrap around a tree or a dock piling.

Other applications for the tray 10 or 80 include: use as a small portable tool box, able to hold small hand tools and be attached to or near a work surface; or a storage tray for TV and video remote controls, readily attachable to almost any table or chair. In the applications mentioned above, and others, users would appreciate the combination of fast and flexible mounting via the mounting tie strap 18, convenient item storage in the tray body 12 or 82, and organization via the rubber twist ties 22. The combination of versatility, flexibility, easy attachment and detachment, light weight, and sturdiness should allow the utility tray 10 and the utility tray 80 to meet the needs of many consumers.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A utility tray comprising:

a tray body for holding items, the tray body including a base portion, opposing first and second portions extending transversely from the base portion, and opposing front and rear face portions extending transversely from the base portion between the first and second portions;

a moveable member hingedly coupled to the rear face portion of the tray body at a point spaced away from the base portion such that the moveable member can be folded down in a closed position to form an enclosure with the tray body, and said moveable member can be folded open generally perpendicular to the tray body in a use position to serve as a back for mounting the utility tray to a mounting structure; and a first rubberized twist tie passing through holes in the moveable member, where the first rubberized twist tie is suitable to attach the utility tray to the mounting structure when the moveable member is in the use position, and to secure the moveable member to the tray body when the moveable member is in the closed position.

2. The utility tray of claim 1 further comprising a closure device for holding the moveable member in the fully closed position on the tray body.

3. The utility tray of claim 2 wherein the closure device is selected from the group consisting of a magnet, a snap and mating pieces of hook and loop fastener material.

4. The utility tray of claim 1 wherein the moveable member is coupled to the tray body with a hinge which prohibits rotation of the moveable member beyond the use position.

5. The utility tray of claim 1 wherein the tray body and the moveable member are constructed of welded wire.

6. The utility tray of claim 5 further comprising a hinge loop extending from said moveable member for hingedly coupling with said tray body.

7. The utility tray of claim 1 wherein the tray body and the moveable member are constructed of molded plastic.

8. The utility tray of claim 1 further comprising a light supported by one of said tray body and said moveable member and operable to illuminate the utility tray when said moveable member is folded open.

9. The utility tray of claim 1 further comprising a tension member attached to the moveable member and the tray body, said tension member restricting the moveable member to a maximum opening angle of 90 degrees from the fully closed position.

10. The utility tray of claim 1 further comprising one or more of a second rubberized twist tie passing through holes in the tray body, where the second rubberized twist tie can be used to secure items inside or outside of the tray body, and the second rubberized twist tie can be removed from the holes in the tray body.

11. A utility tray comprising:

a tray body for holding items the tray body including a base portion and a rear face portions extending transversely from the base portion;

a moveable member hingedly coupled to the rear face portion of the tray body at a point spaced above the base portion such that the moveable member is positionable between a closed position on top of the tray body to form an enclosure and a use position in which the moveable member is generally perpendicular to the tray body and serves as a back for the utility tray; and a bendable rubberized element releasably coupled to the moveable member, wherein the bendable rubberized element is configured to attach the utility tray to an adjacent support when the moveable member is in the use position.

12. The utility tray of claim 11 further comprising a closure device for holding the moveable member in the fully closed position on the tray body.

13. The utility tray of claim 12 wherein the closure device comprises the bendable rubberized element which secures the moveable member to the tray body when the moveable member is in the closed position.

14. The utility tray of claim 12 wherein the closure device is selected from the group consisting of a magnet, a snap and mating pieces of hook and loop fastener material.

15. The utility tray of claim 11 wherein the moveable member is coupled to the tray body with a hinge which prohibits rotation of the moveable member beyond the use position.

16. The utility tray of claim 11 further comprising a light supported by one of said tray body and said moveable member and operable to illuminate the utility tray when said moveable member is in the use position.

17. The utility tray of claim 11 wherein the tray body and the moveable member are constructed of welded wire.

18. The utility tray of claim 17 further comprising a hinge loop extending from said moveable member for hingedly coupling with said tray body.

19. The utility tray of claim 11 wherein the tray body and the moveable member are constructed of molded plastic.

20. The utility tray of claim 11 further comprising a tension member attached to the moveable member and the tray body, said tension member restricting the moveable member to a maximum opening angle of 90 degrees from the fully closed position.

* * * * *